United States Patent [19]

Kohyama

[11] Patent Number: 5,021,808

[45] Date of Patent: Jun. 4, 1991

[54] LASER ACTUATED RECORDING APPARATUS

[75] Inventor: Mitsuaki Kohyama, Higashikurume, Japan

[73] Assignee: Kabushiki Kaisha Toshiba, Kawasaki, Japan

[21] Appl. No.: 418,935

[22] Filed: Oct. 6, 1989

Related U.S. Application Data

[63] Continuation of Ser. No. 235,764, Aug. 23, 1988, abandoned, which is a continuation of Ser. No. 8,535, Jan. 29, 1987, abandoned.

[30] Foreign Application Priority Data

Feb. 10, 1986 [JP] Japan ..... 61-27410
Feb. 10, 1986 [JP] Japan ..... 61-27418
Feb. 17, 1986 [JP] Japan ..... 61-32509

[51] Int. Cl.[5] ..... B41J 2/05; B41J 2/21

[52] U.S. Cl. ..... 346/140 R; 346/76 L; 346/46

[58] Field of Search ..... 346/140, 76 L, 46

[56] References Cited

U.S. PATENT DOCUMENTS 3,655,379 4/1972 Gundlach ..... 346/76 L X
3,798,365 3/1974 Browning ..... 346/76 L X
3,834,301 9/1974 Croquelois et al. .
4,296,421 10/1981 Hara ..... 346/140
4,312,009 1/1982 Lange ..... 346/140
4,369,451 1/1983 Sekido ..... 346/76 PH
4,404,571 9/1983 Kitamura ..... 346/108
4,531,138 7/1985 Endo ..... 346/76 L X
4,603,986 8/1986 Simpson ..... 346/76 L X
4,608,577 8/1986 Hori ..... 346/140
4,630,075 12/1986 Hori ..... 346/140
4,723,129 2/1988 Endo ..... 346/140 X
4,725,860 2/1988 Kohyama ..... 346/140

FOREIGN PATENT DOCUMENTS 0051468 5/1982 European Pat. Off. .
2843064 4/1979 Fed. Rep. of Germany .
3012930 10/1980 Fed. Rep. of Germany .
3606659 8/1986 Fed. Rep. of Germany .
9622 2/1973 Japan .
9429 3/1981 Japan .
61-132036 6/1986 Japan .

*Primary Examiner*—Joseph W. Hartary
*Attorney, Agent, or Firm*—Cushman, Darby & Cushman

[57] ABSTRACT

A laser actuated image recording apparatus having an ink retaining layer. Concentrated light is projected towards a flexible film ink retaining layer so as to heat ink contained thereon and cause bubbles to form in the ink. The bubbles burst and propel ink droplets towards a recording member.

14 Claims, 10 Drawing Sheets

LASER ACTUATED RECORDING APPARATUS

This is a continuation of Ser. No. 07/235,764, filed 8/23/88, now abandoned which was a continuation of Ser. No. 07/008,535, filed 1/29/87, also abandoned.

BACKGROUND OF THE INVENTION

The present invention relates to an ink-jet recording apparatus, a recording head and a recording head cartridge thereof.

Impact and nonimpact recording schemes are available as recording schemes. Among these schemes, the nonimpact recording schemes include electrophotographic, electrostatic, thermal, and ink-jet recording schemes.

Of these nonimpact recording schemes, the ink-jet recording scheme is regarded as the most excellent for its advantages, i.e., low noise, low power, compactness, multi-color constitution, and inexpensive components.

In general, the ink-jet recording scheme is to print an image on recording paper by injecting small ink droplets from capillary nozzles to the paper.

According to the ink-jet recording scheme, various prior systems have been proposed. A first example is a system for instantaneously increasing the pressure of a liquid ink by utilizing vibrations of a piezoelectric element in an ink chamber and for injecting the ink therefrom (Japanese Patent Disclosure (Kokai) No. 9622/73). A second example is a system having heating elements arranged in an ink chamber and adapted to heat the elements to generate bubbles in the ink chamber, thereby increasing the pressure of the ink and hence injecting it from a nozzle (Japanese Patent Publication No. 9429/81).

These systems are so-called on-demand systems for injecting ink as needed. The ink is not wasted, and the recording speed is relatively high. However, the conventional on-demand system has disadvantages. The nozzle tooling, arrangements of the piezoelectric and heating elements in the ink chamber, and the manufacture of the recording head are complicated. The manufacturing cost of the system is high. The system consumes much power thereby increasing the printing cost.

Among the ink-jet recording schemes, the on-demand system is suitable for increasing the recording speed. However, in order to increase the recording speed, the on-demand system is inferior to an electrophotographic system. In addition, the nozzles in the on-demand system tend to clog with dried ink when the system is not used for a long period of time.

According to one of the ink-jet recording systems, ink flies to record an image on recording paper without using the nozzles described above.

A typical example of this system is described in Japanese Patent Disclosure (Kokai) No. 132036/86. A heating element is arranged under ink level and energized to abruptly heat the ink. Bubbles are formed in the ink, and the ink flies upon breaking of the bubble.

According to this system, the nozzles do not clog with dried ink. However, since the heating element comprises an electric resistive element, several tens of microseconds to several milliseconds must be spent to sufficiently heat the electric resistive element. In addition, energy loss caused by heat conduction is also large, and thus heat efficiency is degraded. For this reason, the system is not suitable for high-speed recording.

SUMMARY OF THE INVENTION

It is an object of the present invention to provide an ink-jet recording apparatus free from nozzle clogging and thus capable of printing an image at high speed.

According to one aspect of the present invention, there is provided an ink-jet recording apparatus, which forms an image on a recording member by ejecting ink onto the recording member in response to an image signal, and which comprises ink holding means, opposing the recording member, for holding a layer of ink, and light emitting means for emitting light onto said ink holding means, heating the ink through said ink holding means to generate a bubble in the layer of ink, and causing the ink to fly from said ink holding means to the recording member by a pressure of the bubble.

In the ink-jet recording apparatus according to the present invention, since the ink flies without using nozzles, the nozzle clogging can be eliminated. In addition, the ink is heated by light radiation instead of the heating element used in a conventional arrangement, and high-speed printing can be performed.

BRIEF DESCRIPTION OF THE DRAWINGS

FIGS. 1 to 3C show an ink-jet recording apparatus according to a first embodiment of the present invention, in which FIG. 1 is a side view schematically showing the overall arrangement of the recording apparatus, FIG. 2 is a perspective view showing part of the apparatus, and FIGS. 3A to 3C are sectional views for explaining the operation of the apparatus;

FIGS. 4 to 9 show an ink-jet recording apparatus according to a second embodiment of the present invention, in which FIG. 4 is a side view schematically showing the overall arrangement of the apparatus, FIG. 5 is a partially cutaway perspective view schematically showing the apparatus, FIGS. 6A to 6C sectional views for explaining the operation of the apparatus, FIG. 7 is a sectional view showing a modification of part of the apparatus in FIG. 4, FIG. 8 is a sectional view showing another modification of part of the apparatus in FIG. 4, and FIG. 9 is a perspective view thereof; and FIGS. 10 to 20 show an ink-jet recording apparatus according to a third embodiment of the present invention, in which FIG. 10 is a sectional view schematically showing the overall arrangement of the apparatus, FIG. 11 is a perspective view showing a recording head cartridge of the apparatus, FIG. 12 is a perspective view of the recording head cartridge viewed from a direction different from that in FIG. 11, FIG. 13 is a sectional view showing the recording head cartridge, FIG. 14 is a sectional view showing the exploded recording head cartridge, FIG. 15 is a sectional view of a recording head in the apparatus in FIG. 10, FIG. 16 is a front view of the recording head, FIG. 18 is a perspective view showing a modification of the recording head cartridge, FIG. 19 is a sectional view showing a modification of the recording head, and FIG. 20 is a sectional view showing another modification of the recording head cartridge.

DETAILED DESCRIPTION OF THE PREFERRED EMBODIMENTS

Figure 1:
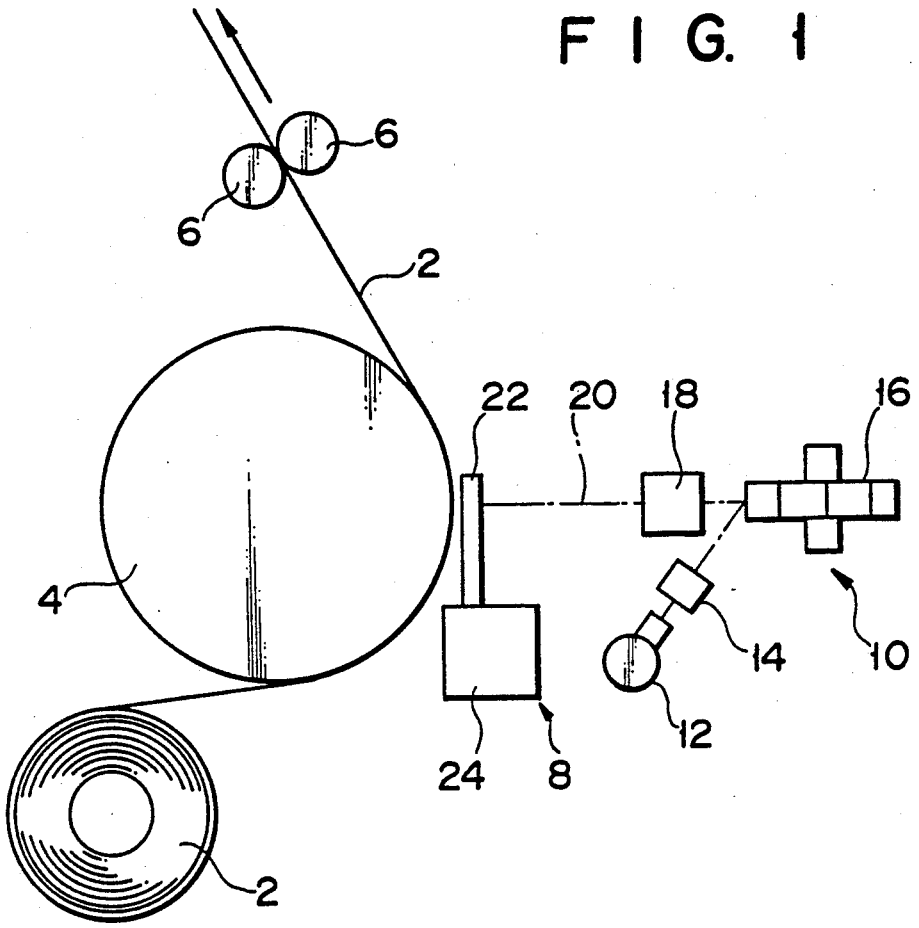

FIGS. 1 to 3C show an ink-jet recording apparatus according to a first embodiment of the present invention. Reference numeral 2 in FIG. 1 denotes a roll of recording paper. Paper 2 is wound around platen roller 4 and clamped between a pair of conveying rollers 6. Paper 2 is continuously fed upon rotation of rollers 4 and 6 and conveyed in a direction of an arrow.

Ink holding unit 8 is arranged at a position opposite roller 4. Illumination unit 10 is arranged opposite roller 4 with respect to unit 8.

Light emitting unit 10 comprises laser generator 12, optical modulator 14, rotary polygonal mirror scanner 16, and focusing lens optical device 18. Generator 12 generates a laser beam having a power of 4 to 8 W. The laser beam propagates along optical axis 20. The laser beam is modulated into an 1-MHz image signal by optical modulator 14. The modulated beam is scanned by optical scanner 16. The scanned laser beam is focused by optical device 18 and becomes incident on glass substrate 22 in ink holding unit 8.

Figure 2:
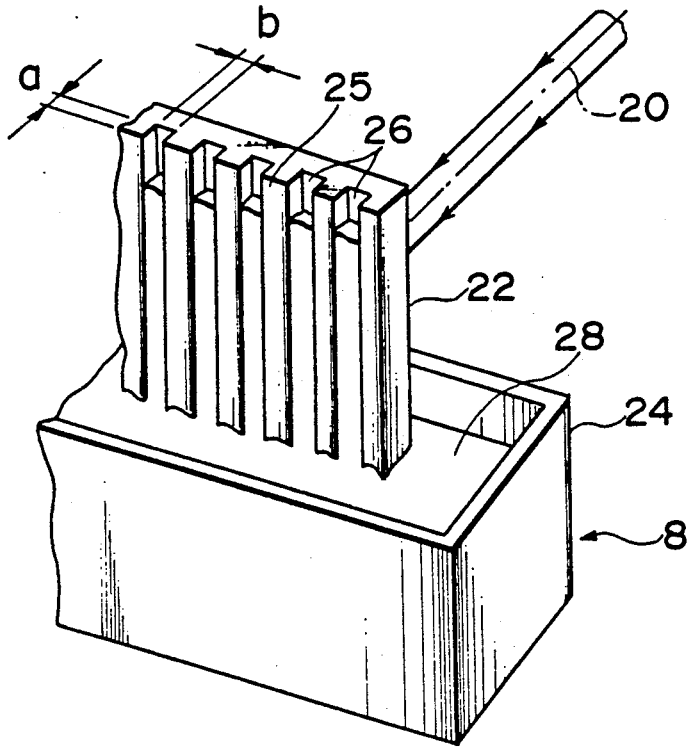

Ink holding unit 8 comprises glass substrate 22 and ink vessel 24, as shown in FIGS. 1 and 2.

Figure 3A:
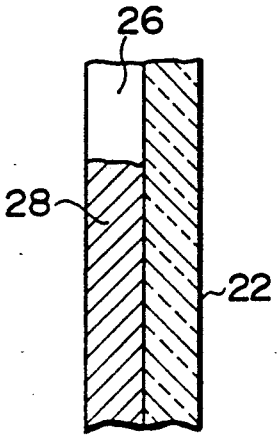
Figure 3B:
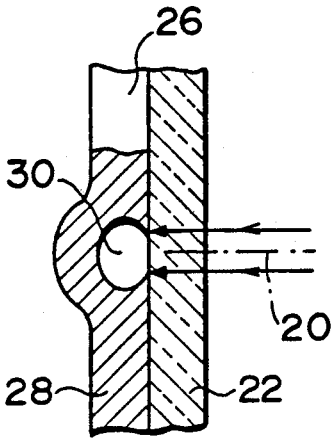
Figure 3C:
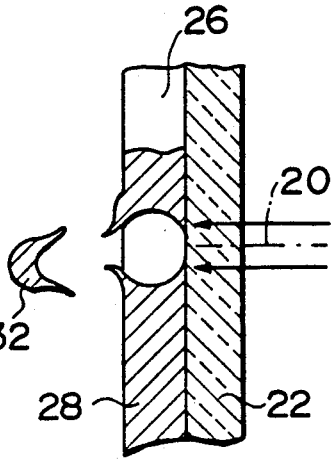
Figure 4:
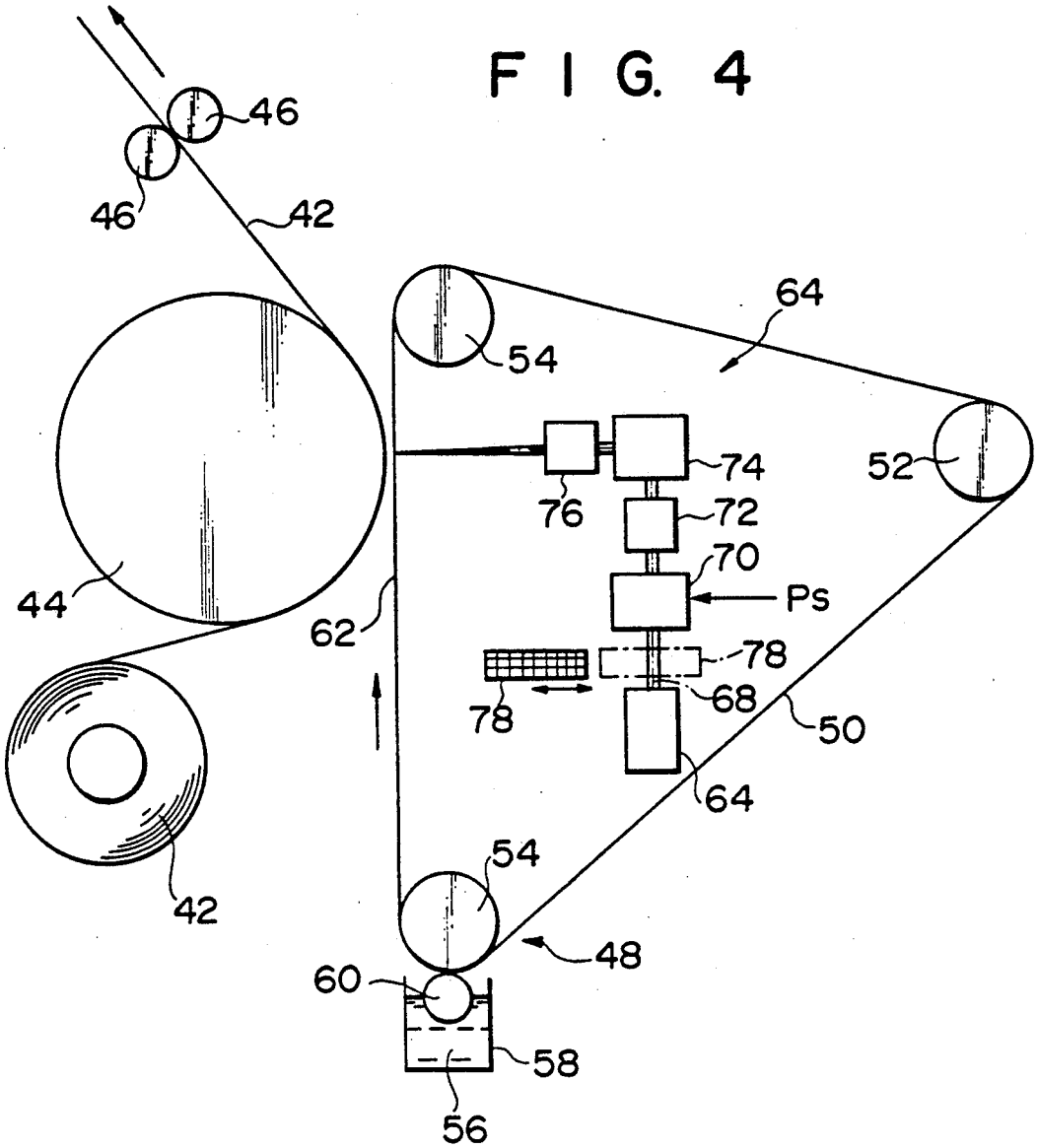
Figure 5:
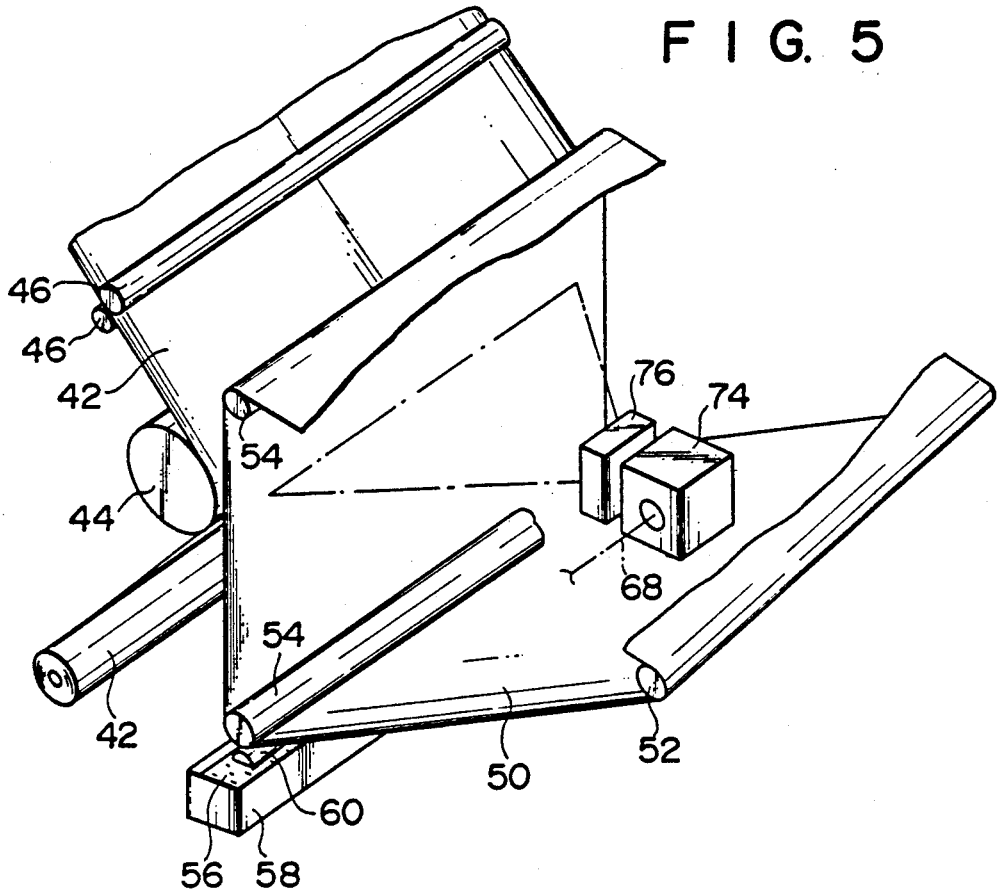

Glass substrate 22 has surface 25 opposite to recording paper 2 supported by platen roller 4. The distance between surface 25 and platen roller 4 is set to be 100 to 1,000 μm. A plurality of grooves 26 are vertically formed in surface 25. Each groove 26 has a depth a of 10 to 100 μm and a width b of 50 to 100 μm. The lower end of glass substrate 22 is dipped in ink 28 in vessel 24. As shown in FIG. 3A, ink 28 in vessel 24 is elevated through grooves 26 in glass substrate 22. As shown in FIG. 3B, elevated ink 28 is evaporated upon heating by the laser beam, and bubble 30 is abruptly generated and increases in size. As shown in FIG. 3C, when bubble 30 further grows and is broken by its pressure, ink droplet 32 flies toward paper 2 and is attached thereto. These series of operations are repeated in response to image signals, and paper 2 is conveyed in synchronism with the image signals. Therefore, an image is formed on paper 2.

With the above arrangement, ink 28 held in grooves 26 in glass substrate 22 flies toward paper, and thus the problem of nozzle clogging can be eliminated. Unlike in a conventional recording apparatus using the heating element, ink 28 is heated upon light radiation to achieve high-speed printing. Ink 28 can be automatically fed without arranging movable members, and the apparatus can be made compact.

FIGS. 4 to 9 show an ink-jet recording apparatus according to a second embodiment of the present invention. Reference numeral 42 in FIG. 4 denotes a roll of recording paper. Paper 42 is wound around platen roller 44 and clamped by a pair of convey rollers 46. Paper 42 is continuously fed and conveyed upon rotation of rollers 44 and 46.

Ink holding unit 48 is disposed at a position opposite platen roller 44.

Ink holding unit 48 includes endless ink film 50. Film 50 is looped between driving roller 52 and a plurality of driven rollers 54. When roller 52 is driven by a motor (not shown), film 50 travels along a direction of an arrow. Film 50 is made of polyimide (available from du Pont de Nemours), polyether ketone, or polyethersulfone (available from Sumitomo Bakelite Co., Ltd.) which has heat-resistant (at least 100° C. or more; and practically 180° C. or more) and light-transmitting properties. Film 50 should be as thin as possible to have the best possible light-transmitting properties, but its thickness is preferably about 50 μm in practice.

Ink vessel 58 for storing commercially available water-soluble ink 56 is disposed near one driven roller 54. Ink form roller 60 is disposed in vessel 58 and abuts against part of surface 62 opposite platen roller 44 to apply ink 56 to surface 62. In practice, a film of ink 56 having a thickness of about 20 to 80 μm is coated on surface 62 of layer 50 by form roller 60. A gap of about 0.2 to 1 mm is formed between paper 42 and the layer of ink 56 coated on film 50.

Light emitting unit 64 is arranged opposite platen roller 44 with respect to ink film 50. Unit 64 emits a laser beam onto a rear surface of ink film 50, i.e., a surface opposite surface 62. A laser source of unit 64 comprises carbon dioxide laser generator 66. A laser beam emitted from generator 66 propagates along optical axis 68 and is supplied to optoacoustic element 70. Image signal Ps representing an image to be printed is supplied to element 70. The laser beam input to element 70 is modulated in response to signal Ps. The modulated laser beam is incident on optical scanner 74 through optical device 72. Scanner 74 comprises a known rotary polygonal mirror (not shown) rotated by a driver (not shown). The laser beam incident on optical scanner 74 is scanned by the rotary polygonal mirror in a direction of width (the horizontal direction in this embodiment) of ink film 50. The laser beam scanned by optical device 74 is incident on the rear surface of film 50 through optical lens 76. Heat radiation shutter 78 is inserted between laser generator 66 and optoacoustic element 70 in a direction of an arrow. When shutter 78 is inserted between generator 66 and element 70, as indicated by the alternate long and two short dashed line, the laser beam is shielded.

The diameter of a laser spot on ink film 50 is determined by a required pixel density. In this embodiment, the laser spot has a diameter of about 80 μm. An output from the laser generator is set to provide optical energy of 2 to 10 millijoule/cm$^2$ when the laser spot is formed on the rear surface of film 50 under the condition that a total loss of energy of the laser beam is given to be 30 to 65%. In order to obtain the above energy, in this embodiment, a carbon dioxide gas laser generator LAC-554 available from Toshiba Corp. or 81-5500 available from LASER Sonics Corp can be used.

Most of the recent laser beams with several watts to 10 watts are mainly obtained by gas lasers. However, semiconductor lasers capable of obtaining such high output energy have been developed and are about to be introduced. Therefore, more compact laser generators using semiconductor lasers are able to be produced at low cost.

The operation of the ink-jet recording apparatus of this embodiment will be described below.

Figure 6A:
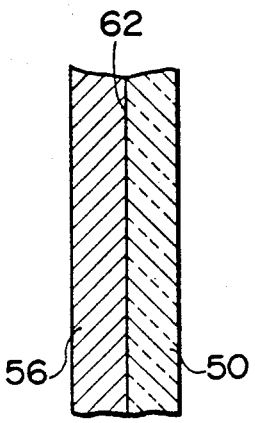
Figure 6B:
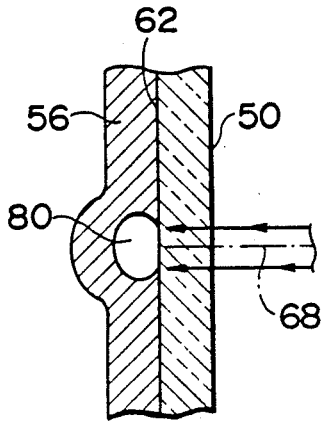
Figure 6C:
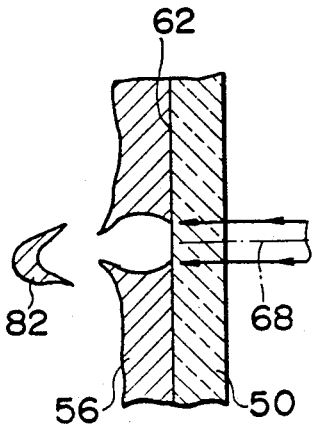

Ink 56 is coated on opposite surface 62 of film 50 by form roller 60, as shown in FIG. 6A. A laser beam is incident on the rear surface of film 50. When energy of about 20 to 40 erg/dot is generated, ink 56 is heated to 100° C. or more. As shown in FIG. 6B, bubble 80 is generated inside ink 56. Bubble 80 grows larger and is broken by its pressure. As shown in FIG. 6C, ink droplet 82 flies toward recording paper 42. The series of operations as described above are repeated in response to image signals Ps, and paper 42 is conveyed in synchronism with image signal Ps, thereby forming an image on paper 42.

Ink 56 on ink film 50 is heated by a laser beam having an interval of 1 μs to 0.1 μs and the above-mentioned power. For this reason, it is possible to obtain 10 to 100 images per second each having a A4 size in a recording density of 10 lines/mm.

According to the above embodiment, a thin layer of ink 56 is formed on the opposite surface of ink film 50, and a laser beam is incident on the rear surface of film 50. Ink 56 is heated to generate bubble 80 inside ink 56. In this case, since ink 56 coated on ink film 50 is very thin, bubble 80 is generated at the irradiated portion of film 50. For this reason, the flying position of ink droplet 82 formed by breaking of bubble 80 is not misaligned with the irradiated portion of film 50.

The layer of ink 56 coated on film 50 is thin and is heated by the laser beam. Ink 56 is then heated for a very short period of time to break the bubble. Unlike the case wherein the layer of ink 56 is thick, light is not absorbed in the layer of ink 56. Therefore, bubble 80 can be effectively generated in response to energy of the laser beam, and hence high-speed printing can be performed.

Ink 56 opposes recording paper 42 while ink 56 is coated on opposite surface 62, so that the distance between paper 42 and ink 56 on film 50 can be kept unchanged. Therefore, ink 56 can be accurately transferred onto paper 42.

Ink 56 is coated on ink film 50 by form roller 60. Even if the apparatus is slightly inclined and installed, ink 56 can be uniformly coated onto film 50. The resultant image is not adversely affected. In addition, the installation location of the apparatus is not limited.

Since ink 56 coated on ink film 50 is heated by the laser beam, necessary energy can be greatly reduced as compared with the case wherein the ink is heated by a heating element. Furthermore, as compared with the case wherein a laser beam is incident on ink in an ink vessel, laser beam loss is small, and hence power consumption can be reduced.

Figure 7:
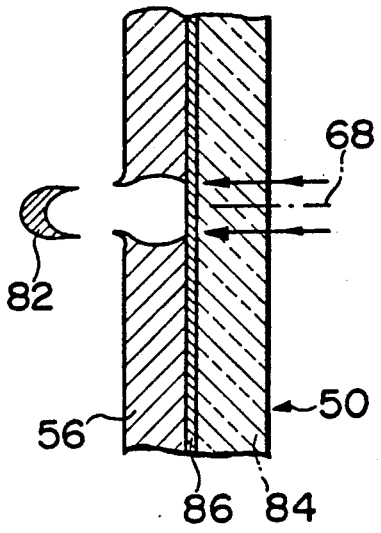

FIG. 7 shows a modification of ink film 50. Ink film 50 in this modification includes light-transmitting film 84. Light-absorbing film 86 is adhered to the surface of film 84 so as to oppose platen roller 44. Ink 56 is then coated on film 86. Film 86 is selected according to the light-absorbing and heat-resistant properties of the laser beam as well as adhesion strength with film 84. In this modification, film 86 is prepared such that carbon, manganese dioxide, or lanthanum-cobalt oxide is dispersed in polyimide, and the resultant mixture is uniformly coated on film 84 to a thickness of 5 to 20 microns.

With the above construction, even if the ink itself does not have light-absorbing property, ink 56 can be heated. In this sense, red or yellow ink 56 may be used.

Figure 8:
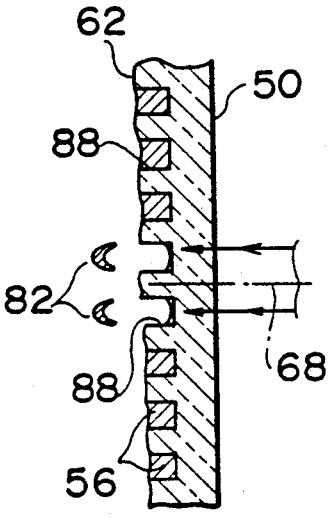
Figure 9:
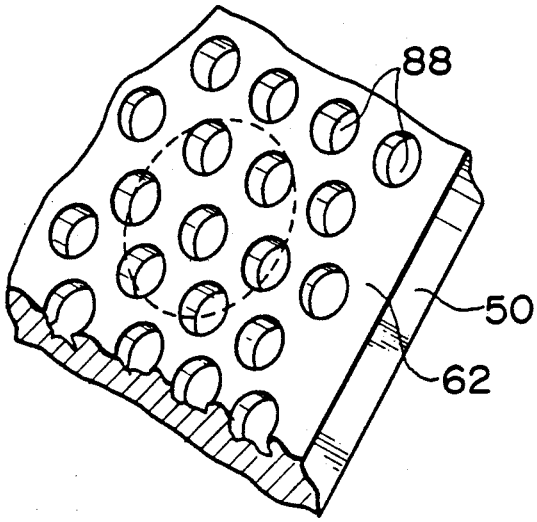
Figure 10:
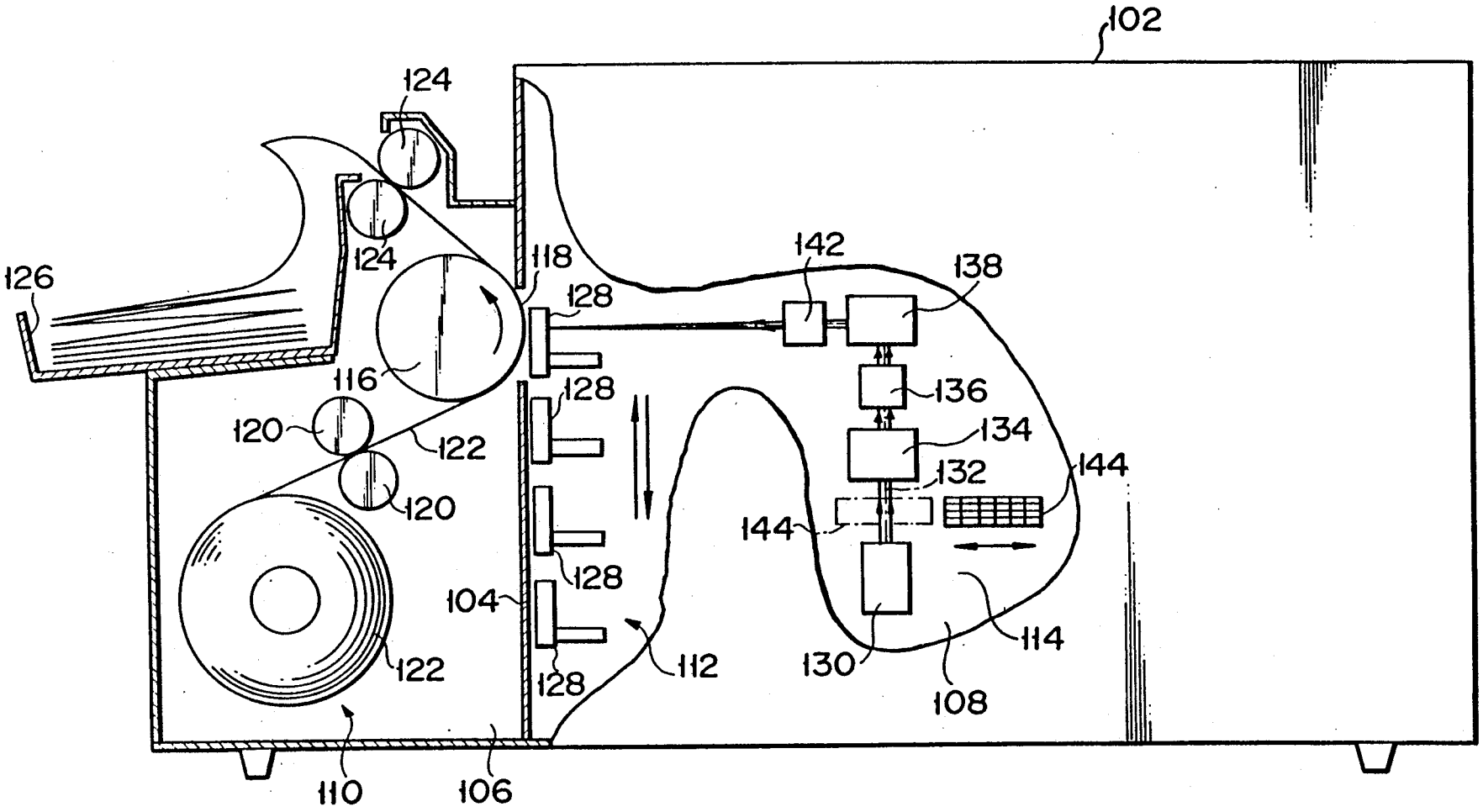
Figure 11:
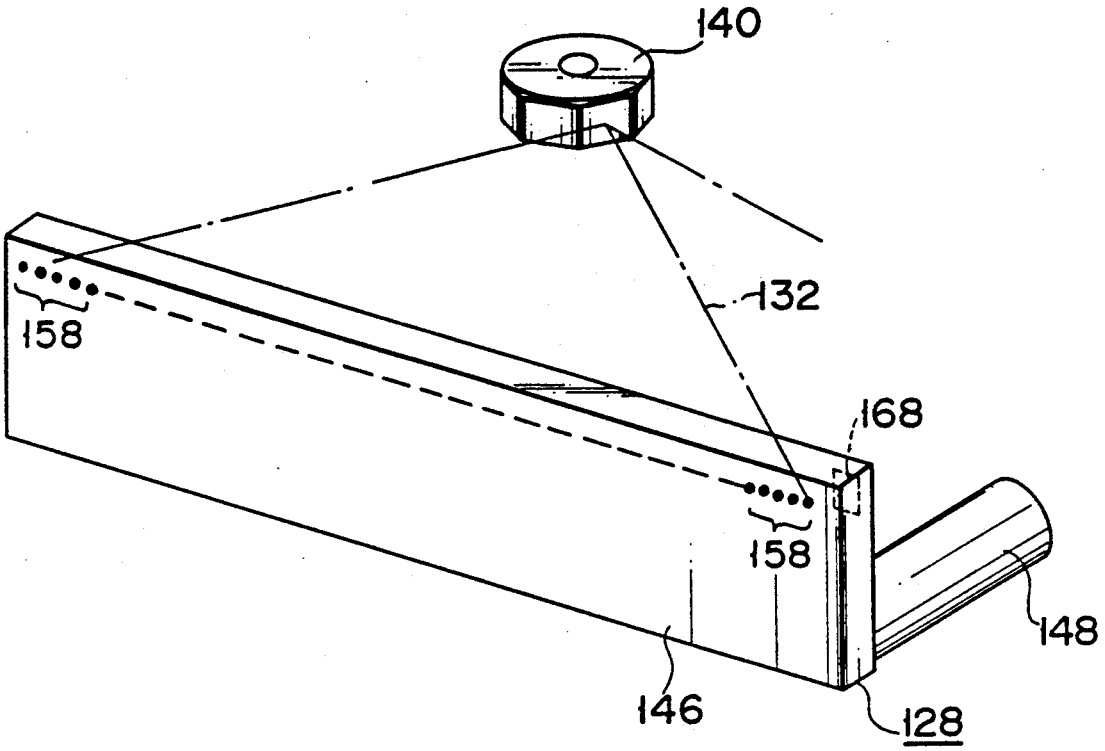

FIGS. 8 and 9 show another modification of ink film 50. In this modification, a large number of pores 88 are formed in opposite surface 62 of film 50. Ink 56 is stored in pores 88. Each pore 88 has a diameter of 30 to 50 microns and a depth of 10 to 100 microns, and pores 88 are formed at high density. The diameter of the laser beam is determined such that the beam spot is formed across a plurality of pores 88, as indicated by a circle of a broken line.

With this construction, when ink droplet 82 flies, the flying direction is kept in one direction. Since the laser spot is formed across a plurality of pores 88, ink 56 held in irradiated pores 88 can fly even if some pores 88 do not contain ink 56, thereby preventing recording errors.

In the second embodiment, ink film 50 has at least a portion with light-transmitting property. However, even if ink film 50 has-no light-transmitting property, it may be used if ink 56 coated on the opposite surface can be heated upon laser radiation.

FIG. 10 to 20 show an ink-jet recording apparatus according to a third embodiment of the present invention. Reference numeral 102 in FIG. 10 denotes a housing. The interior space of housing 102 is partitioned by partition wall 104 into first and second chambers 106 and 108. Paper feed unit 110 is arranged in chamber 106, and ink holding unit 112 and light emitting unit 114 are arranged in chamber 108.

Paper feed unit 110 has platen roller 116. Part of the outer surface of roller 116 extends into second chamber 108 through window 118 formed in partition wall 104. A pair of paper feed rollers 120 are disposed below roller 110. Rollers 120 continuously feed paper from a roll of recording paper 122, and paper 122 is then conveyed to roller 116. Paper 122 is then fed to a pair of delivery rollers 124 and delivered thereby outside onto tray 126 disposed at the upper portion of housing 102.

Ink holding unit 122 comprises a plurality of recording head cartridges 128 having an identical arrangement. Cartridges 128 contain inks of different colors such as red, green, blue, and black. Cartridges 128 are arranged to be vertically movable (i.e., in a direction of an arrow) and can be manually or automatically located by a selecting device (not shown) at a position opposite roller 116. The distance between selected cartridge 128 and roller 116 is set to be, e.g., 0.5 to 3 mm.

Light emitting unit 114 emits a laser beam onto selected recording head cartridge 128 and comprises a laser source such as carbon dioxide gas laser generator 130. The laser beam from generator 130 propagates along optical axis 132 and is input to optoacoustic element 134. Element 134 also receives an image signal representing an image to be printed. The input laser beam is modulated in response to this image signal. The modulated laser beam is incident on optical scanner 138 through optical device 136 for shaping a beam. Scanner 138 comprises known rotary polygonal mirror 140 (FIG. 11) driven by a driver (not shown). The laser beam incident on optical scanner 138 is reflected by mirror 140 and propagates along the longitudinal direction (e.g., the horizontal direction) of cartridge 128. The laser beam is then incident on the rear surface of recording head cartridge 128 through, e.g., optical lens 142.

Heat radiation shutter 144 can be inserted between laser generator 130 and optoacoustic element 134, as indicated by an arrow. In the non-imaging mode, shutter 144 is inserted between generator 130 and element 134, as indicated by the alternate long and two short dashed line, thereby blocking the laser beam.

Each recording head cartridge 128 has recording head 146 and ink cartridge 148, as shown in FIGS. 11 to 16. Head 146 comprises head substrate 150 and porous plate 152. Substrate 150 comprises a 0.5-mm thick light-transmitting heat-resistant glass plate. Plate 152 is adhered to the front surface of substrate 150. Plate 152 comprises a 20–50-$\mu$m thick nickel plate. The rear surface of plate 152 is recessed. In a state wherein plate 152 is adhered to substrate 150, ink chamber 156 is formed to store ink 154 therein. A plurality of ink ejection apertures 158 are formed at the upper portion of the front surface of plate 152 along the longitudinal direction thereof. Each aperture 158 has a diameter of, e.g., 60 microns, and apertures 158 are aligned with constant intervals therebetween. For example, 10 apertures are arranged in a line per mm. Apertures 158 communicate with chamber 156.

Partition wall 160 is formed between each two adjacent ink injection apertures 158 formed in the rear surface of porous plate 152. In a state wherein plate 152 is adhered to head substrate 150, wall 160 is in contact with the front surface of substrate 150. Therefore, ink chamber 156 is partitioned in units of apertures 158. Distance c between the rear surface of plate 152 and the front surface of substrate 150 is set to be 30 to 700 μm. This distance is determined according to an amount of ink 154 ejected from apertures 158 and the heating characteristics of ink 154.

Light-absorbing film 162 is formed on the front surface of head substrate 150 so as to oppose ink ejection apertures 158. This light-absorbing film 162 is prepared such that 50 to 75% by weight of black powder such as carbon black, manganese dioxide, or lanthanum-cobalt oxide is dispersed in a varnish-like polyimide precursor (BPDA type polyiamic acid solution), the resultant solution is coated on head substrate 150 to form a film having a thickness of 2 to 10 μm, and the film is heated to 450° C. Film 162 may be formed such that gold or platinum is subjected to film formation on colloidal particles to prepare a gold or platinum black film, and that the resultant film is protected by polyimide resin. Alternatively, film 162 may be prepared by forming a black oxide film on substrate 150 by ion sputtering or the like. The laser beam from light emitting unit 114 is incident on film 162.

Mounting portion 164 is formed at the lower portion of the rear surface of head substrate 150 to communicate with ink chamber 156. Ink cartridge 148 is attached to mounting portion 164. Ink cartridge 148 is made of an elastic material such as rubber. Commercially available ink-jet water-soluble ink 154 is stored in cartridge 148. Ink 154 is supplied to chamber 156 through filter 166.

Figure 12:
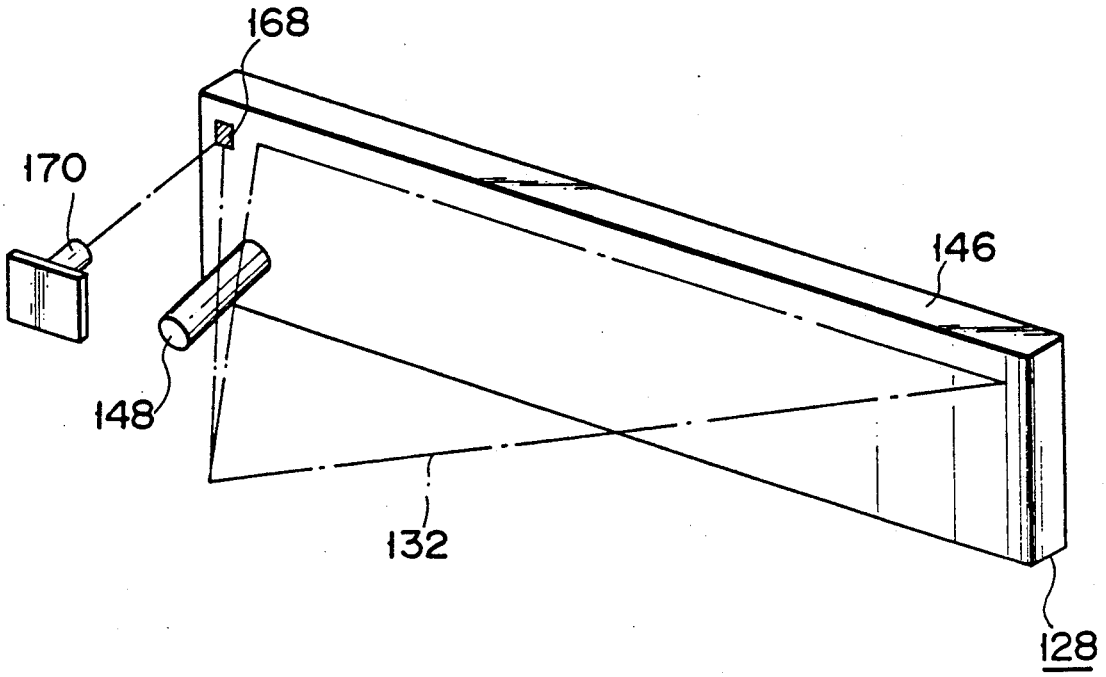
Figure 13:
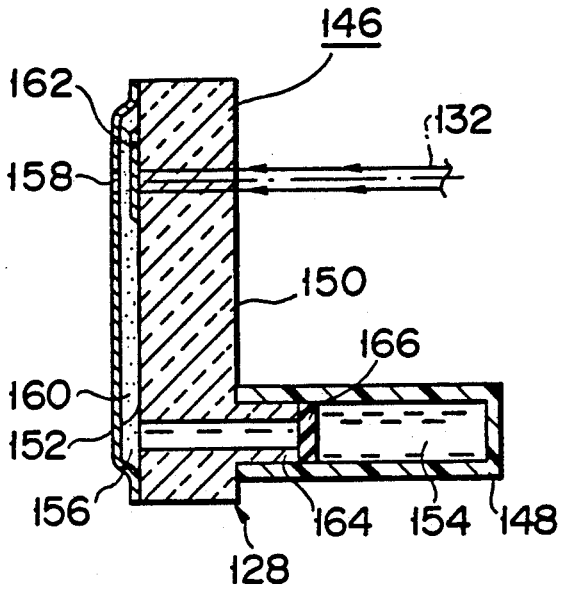
Figure 14:
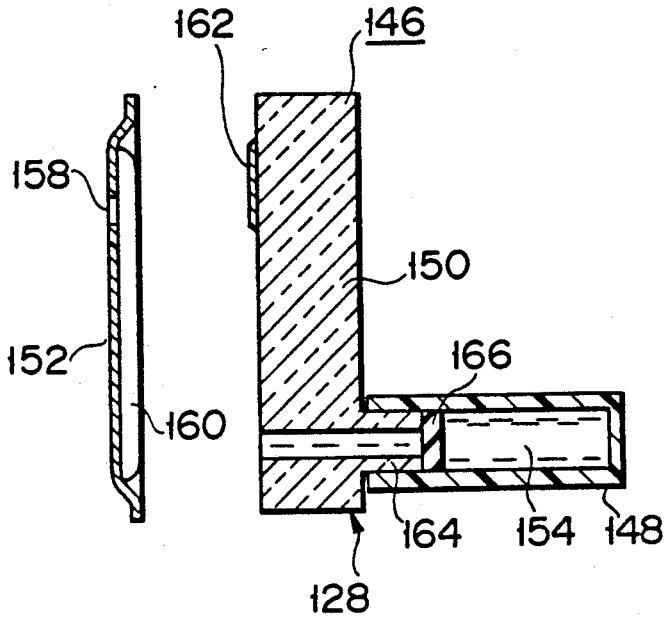
Figure 15:
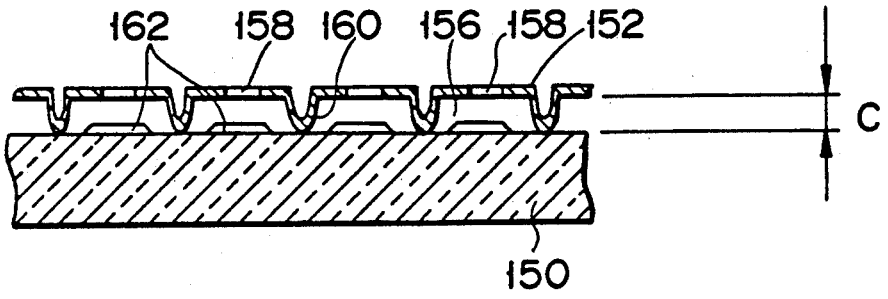
Figure 16:
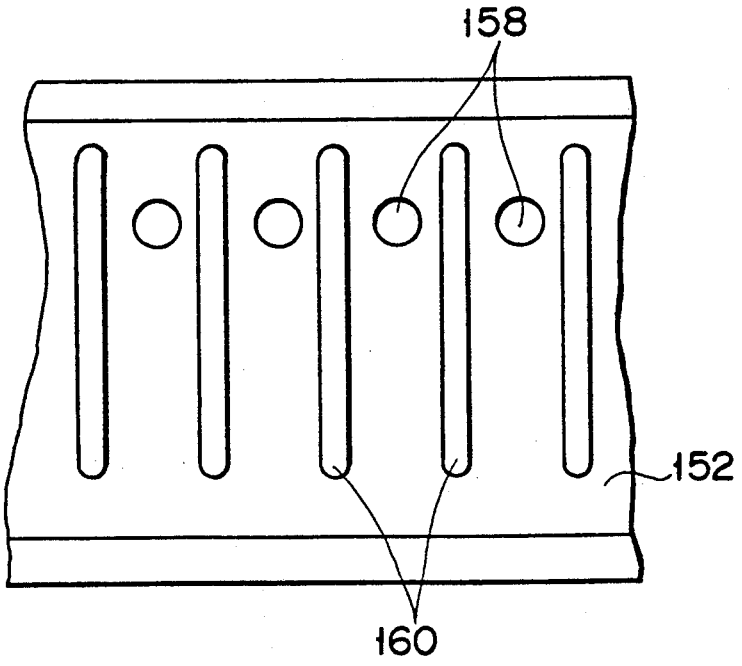

As shown in FIG. 12, reflecting member 168 is arranged near the scanning start position of the laser beam on the rear surface of head substrate 150. Photosensor 170 comprising, e.g., a PIN photodiode is arranged at a position opposite member 168. At the start of scanning, the laser beam is reflected by member 168. The reflected laser beam is incident on photosensor 170. An output signal from photosensor 170 is supplied to a controller (not shown) and is used as a printing start timing sync signal.

The principle of recording using the record head having the above construction will be described below.

Figure 17A:
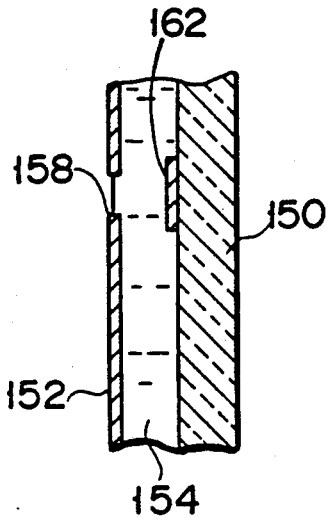
FIGS. 17A to 17D are sectional views for explaining the operation of the apparatus.
Figure 17B:
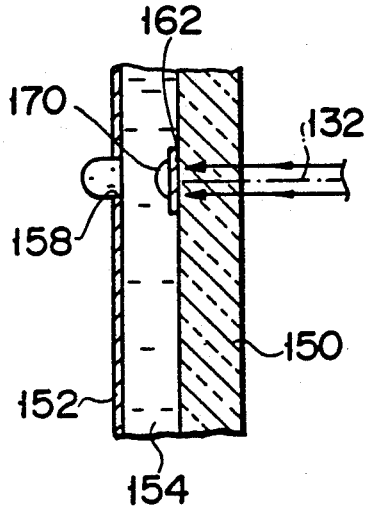
Figure 17C:
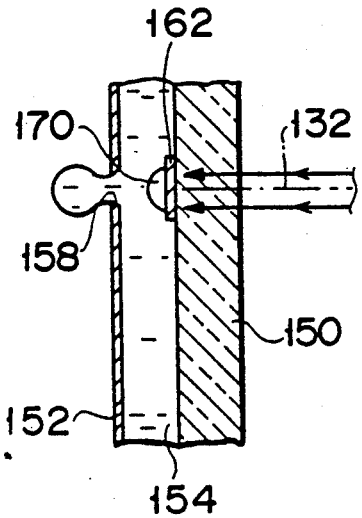
Figure 17D:
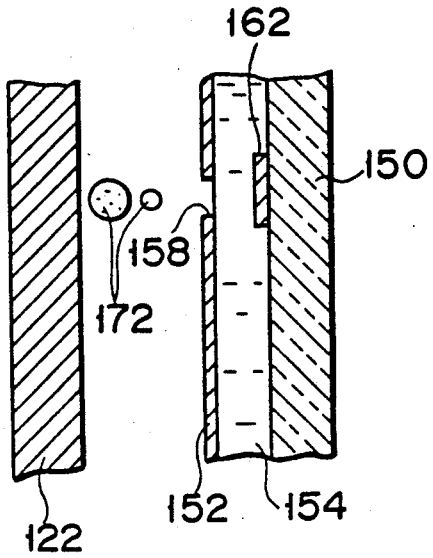

As shown in FIG. 17A, ink chamber 156 is filled with ink 154. In this state, as shown in FIG. 17B, when light-absorbing film 162 on head substrate 150 is irradiated with the laser beam, ink 154 located at the irradiated portion is heated. When ink 154 is heated to about 100° C., bubble 170 is generated in ink 154. Ink 154 is ejected from ink ejection aperture 158 by the pressure of bubble 170. In this state, when ink 154 is further heated, bubble 170 abruptly grows, and ink 154 is ejected from aperture 158 by its pressure, as shown in FIGS. 17C and 17D. Ink droplet 172 is transferred onto recording paper 122. Thereafter, when laser radiation is completed, ink 154 is cooled. As shown in FIG. 17D, bubble 170 disappears. In this state, the interior of chamber 156 is held at a negative pressure according to the volume of ejected ink droplets 172, and ink 154 in cartridge 148 is naturally stored in chamber 156.

As is apparent from the above description, the laser beam modulated according to the image signal is emitted onto head substrate 150 along ink ejection apertures 158, and ink 154 is continuously ejected from apertures 158, thereby forming an image on recording paper 122.

Recording is performed in response to color-separated image signal components. In this case, when recording with ink 154 of one color is completed, the corresponding cartridge 128 is replaced with the next cartridge. At the same time, paper 122 returns to the recording start position, and recording with another color is then initiated. The above operation is repeated for inks 154 of other colors, thereby forming a color image.

Small ink droplets 172 may often be formed upon injection of ink 154. Since recording head 146 is located near recording paper 122, degradation of the image, however, rarely occurs.

In this embodiment, ink 154 can be ejected by energy of 20 to 40 erg/dot, and laser generator 130 having an output of a few watts can be used. In addition, ink 154 in ink chamber 156 is heated upon radiation of the laser beam having the above energy for an interval of 1 μs to 0.1 μs. Therefore, at least 10 images per minute each having an A4 size can be formed per minute at a recording density of 10 lines/mm. The upper limit of the recording speed is determined by so-called thermal history wherein recording characteristics are changed by heat accumulation in head substrate 150. However, if heat radiation of substrate 150 can be efficiently performed, the recording speed can be further increased.

In the above embodiment, porous plate 152 having ink ejection apertures 158 comprises a very thin metal plate. Apertures 158 tend not to clog with ink 154. If clogging occurs, it can be eliminated by applying a small pressure to porous plate 152, thereby simplifying handling.

A space between the rear surface of porous plate 152 defining ink chamber 156 and the front surface of head substrate 150 is very small. Since ink 154 stored in this narrow space is heated, ink 154 can be heated in a very short period of time and bubble 170 is generated. Therefore, bubbles can be efficiently generated, and the printing speed can be greatly increased.

Since ink 154 in ink chamber 156 can be efficiently heated, energy can be greatly saved, as compared with the case wherein a heating element is used. Even compared with a conventional case wherein a laser beam is used, laser beam loss is small, and power consumption can be greatly reduced.

Ink 154 is stored in the interior of ink chamber 156, and only ink ejection apertures 158 oppose recording paper 122. For this reason, the distance between ink 154 in recording head 146 and paper 122 is always kept unchanged. Therefore, ejected ink 154 can be accurately transferred to paper 122. Ink 154 is stored in ink chamber 156 and ink cartridge 148, and this does not limit the installation position of the recording apparatus. Furthermore, since ink 154 is automatically supplied from cartridge 148 to chamber 156, the recording apparatus is very convenient.

Recording head 146 is integrally formed with ink cartridge 148 to constitute recording head cartridge 128. It is easy to attach recording head 146 and ink cartridge 148 to the apparatus or detach them from the apparatus.

The fabrication cost of recording head cartridge 128 can be reduced to 1/50 as compared with the case using a heating element, thus providing an economical advantage.

Light-absorbing film 162 is formed on the front surface of head substrate 150 to absorb the incident laser beam. A high light absorbency can be obtained, and color ink 154 such as a yellow color ink having a low light absorbency can be effectively heated.

The plurality of partition walls 160 are formed inside chamber 156. Chamber 156 is partitioned by the partition walls in units of ink ejection apertures 158. Therefore, ejection of ink 154 by bubble 170 generated in the adjacent position can be prevented.

Figure 18:
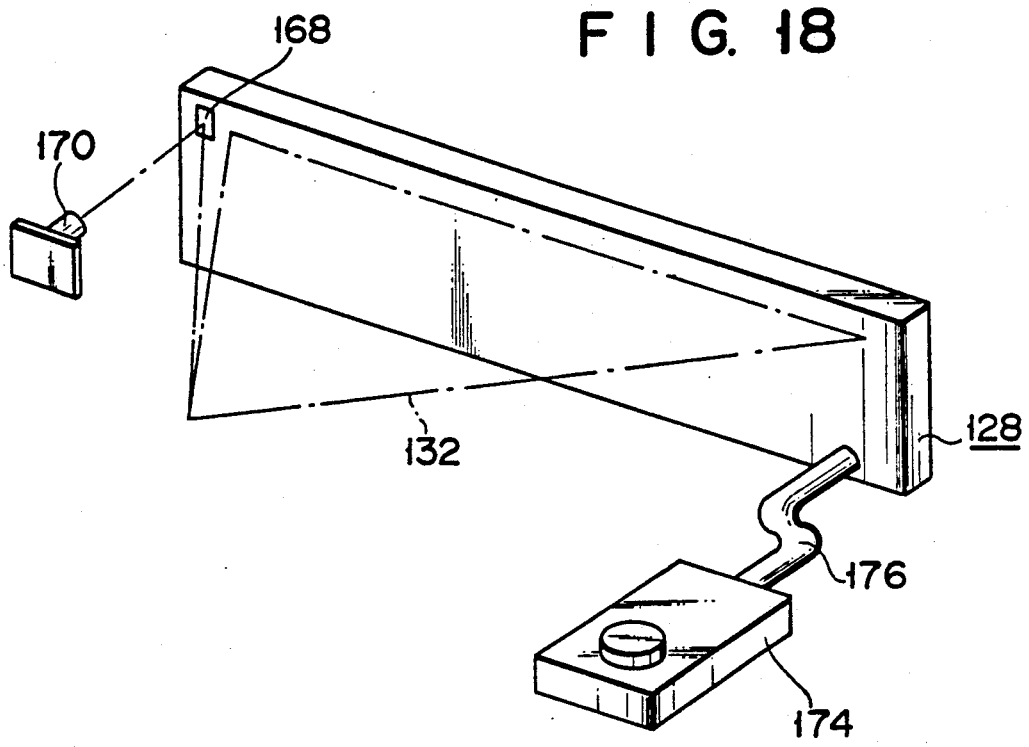

FIG. 18 shows a modification of recording head cartridge 128. In cartridge 128 in this modification, ink vessel 174 for storing a large amount of ink 154 is used in place of ink cartridge 148. Vessel 174 is connected to mounting portion 164 of head substrate 150 through pipe 176. With this construction, the storage capacity for ink 154 can be increased. Therefore, recording for a large number of images can be continuously performed.

Figure 19:
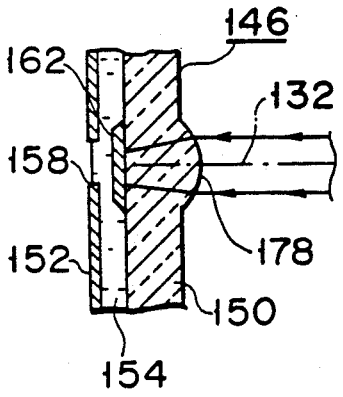

FIG. 19 shows a modification of recording head 146. Head 146 in this modification comprises collecting lens 178 at the laser beam incident portion of head substrate 150. With this construction, an energy density of light-absorbing film 162 can be increased. Heating efficiency for ink 154 can be further improved.

Figure 20:
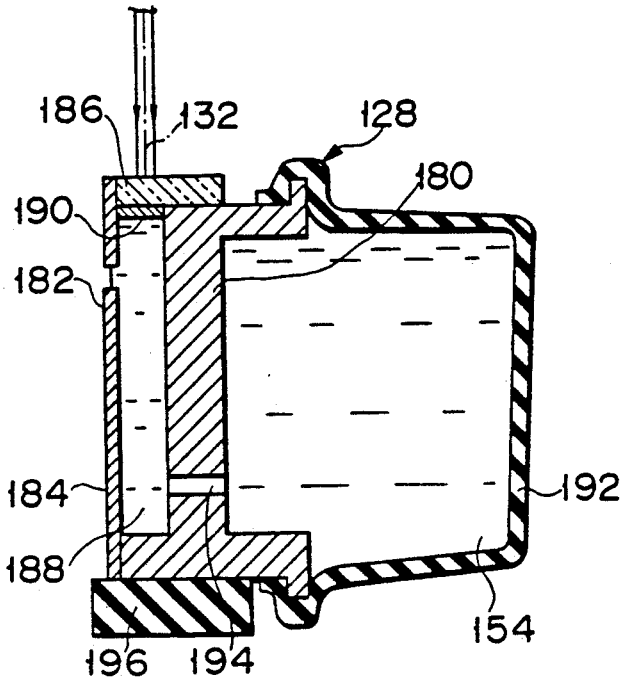

FIG. 20 shows a modification of recording head cartridge 128. Cartridge 128 in this modification comprises substrate 180. Substrate 180 comprises a metal (e.g., aluminum or brass) having a high heat conductivity. Porous plate 184 having a plurality of ink injection apertures 182 is spaced by a predetermined distance part from the front surface of substrate 180. Head substrate 186 made of transparent glass is formed on the upper end faces of porous plate 184 and substrate 180. Substrate 180 closes the upper opening between substrate 184 and plate 184. Substrate 180, plate 184 and substrate 186 define ink chamber 188. Light-absorbing film 190 is formed on the inner surface portion of substrate 186 defining ink chamber 188. Ink cartridge 192 of, e.g., rubber is mounted on the rear surface portion of substrate 180. Ink cartridge 192 communicates with chamber 188 through through hole 194 formed in substrate 180. Ink 154 stored in cartridge 192 is supplied to chamber 188 through hole 194. Ink absorbing member 196 of, e.g., sponge is disposed on the lower end face of substrate 180. Partition walls (not shown) are formed to partition chamber 188 in units of apertures 182.

With the above construction, when a portion of head substrate 186 is irradiated with a laser beam, ink 154 at the irradiated portion is heated. Bubble 170 is generated in ink 154 Along with the growth of bubble 170, ink 154 is ejected from aperture 182 and is transferred to recording paper 122 to form an image.

With this construction, since head substrate 186 is formed on metal substrate 180, heat generated by substrate 186 can be conducted to substrate 180 and can be easily dissipated. Substrate 186 can be effectively cooled, and the printing speed can be further increased.

The entire rear surface of substrate 180 serves as a portion for storing ink 154, and thus a large amount of ink 154 can be stored.

In the third embodiment, transparent substrates 150 and 186 are used. However, the present invention is not limited to this. For example, a nontransparent head substrate may be used if ink 154 at ink ejection apertures 182 can be selectively heated upon laser radiation.

What is claimed is:

1. A laser — actuated recording apparatus comprising:

recording member supporting means for supporting a recording member;

an ink holding unit including a plurality of recording head cartridges, a plurality of ink vessels containing inks, and a plurality of ink supply pipes detachably connecting said ink vessels to said recording head cartridges, said ink holding unit selectively locating one of said recording head cartridges at a position opposite to said recording member supporting means, and each of said recording head cartridges forming a layer of ink, supplied from a corresponding one of said ink vessels through a corresponding one of said ink supply pipes, on its opposing surface which is opposite to said recording member supporting means when it is located at the opposing position; and means for heating the layer of ink on the opposing surface of one of said recording head cartridges to generate a bubble in the layer of ink and causing the ink to fly from one of said recording head cartridges toward the recording member supported by said recording member supporting means by a pressure of the bubble.

2. An apparatus according to claim 1, wherein each of said recording head cartridges includes a base member, an ink-holding-chamber forming member mounted on said base member to form an ink holding chamber for storing a layer of ink, and a light guide means for guiding a laser beam onto said recording head cartridge into the ink holding chamber, said ink-holding-chamber forming member has a plurality of ink ejecting pores through which ink is ejected from the ink holding chamber by a pressure of the bubble.

3. An apparatus according to claim 2, wherein said heating means has laser beam emitting means for emitting a laser beam onto one of said recording head cartridges located at the opposing position, and heating the layer of ink on the opposing surface of one of said recording head cartridges to generate a bubble therein, wherein said base member has a light-transmitting property and constitutes said light guide means.

4. An apparatus according to claim 3, wherein each of said recording head cartridges includes a plurality of light-absorbing members mounted in the ink holding chamber so as to face the ink ejecting pores, said laser beam emitting means emits said laser beam to eject ink from at least a selected one of the ink ejecting pores, and the laser beam emitted into the ink holding chamber through said light guide means is applied onto at least one of said light absorbing members corresponding to at least said selected one of the ink ejecting pores.

5. An apparatus according to claim 4, wherein said light guide means includes a plurality of laser-beam collecting lenses mounted to correspond to said plurality of light-absorbing members, so that the laser beam emitted into the ink holding chamber through said light guide means is effectively applied onto at least one of said light absorbing members corresponding to at least said selected one of the ink ejecting pores.

6. An apparatus according to claim 5, wherein said heating means has laser beam emitting means for emitting a laser beam onto one of said recording head cartridges located at the opposing position, and heating the layer of ink on the opposing surface of one of said recording heat cartridges to generate a bubble therein, said base member has a light-transmitting property and constitutes said light guide means.

7. An apparatus according to claim 2, wherein said ink-holding-chamber forming member includes a plurality of partition walls provided between the adjacent ink ejection pores so as to partition the ink holding chamber into a plurality of small sections each of which has one ink ejecting pore.

8. An apparatus according to claim 7, wherein said heating means includes laser beam emitting means for emitting a laser beam onto one of said recording head cartridges located at the opposing position, and heating the layer of ink on the opposing surface of one of said recording head cartridges to generate a bubble therein, said base member has a light-transmitting property and constitutes said light guide means.

9. An apparatus according to claim 8, wherein each of said recording head cartridges includes a plurality of light-absorbing members mounted in the ink holding member so as to face the ink ejecting pores, said laser beam emitting means emits a laser beam to eject ink from at least a selected one of the ink ejecting pores, and the laser beam emitted into the ink holding chamber through said light guide means is applied onto at least one of said light absorbing members corresponding to at least said selected one of the ink ejecting pores.

10. An apparatus according to claim 9, wherein said light guide means includes a plurality of laser-beam collecting lenses mounted to correspond to said plurality of light-absorbing members, so that the laser beam emitted into the ink holding chamber through said light guide means is effectively applied onto at least one of said light absorbing members corresponding to at least said selected one of the ink ejecting pores.

11. An apparatus according to claim 1, wherein said heating means has laser beam emitting means for emitting a laser beam onto one of said recording head cartridges located at the opposing position, and heating the layer of ink on the opposing surface of one of said recording head cartridges to generate a bubble therein, said base member has a light-transmitting property and constitutes said light guide means.

12. A laser-actuated recording apparatus comprising:

recording member supporting means for supporting a recording member;

an ink holding unit including a plurality of recording head cartridges, a plurality of elastic ink cartridges detachably attached to one side surface of said recording head cartridges so as to cover the one side surface thereof and containing inks, said ink holding unit selectively locating one of said recording head cartridges at a position opposite to said recording member supporting means, so that the other side surface of the selected recording head cartridge, which is located at the opposing side of said head cartridge to one side surface thereof, faces the recording member supported by said recording member supporting means, each of said recording head cartridges forming a layer of ink, supplied from corresponding one of said elastic ink cartridges, on the other side surface thereof; and means for heating the layer of ink on the other side surface of one of said recording head cartridges to generate a bubble in the layer of ink and causing the ink to fly from one of said recording head cartridges toward the recording member supported by said recording member supporting means by a pressure of the bubble.

13. An apparatus according to claim 12, wherein each of said recording head cartridges includes said heating means and said heating means includes laser beam emitting means for emitting laser beam onto one of said recording head cartridges located at the opposing position, and heating the layer of ink on the opposing surface of one of said recording head cartridges to generate a bubble therein, a base member, an ink-holding-chamber forming member mounted on said base member to form an ink holding chamber for storing a layer of ink, and a light guide means for guiding the laser beam emitted onto said recording head cartridge into the ink holding chamber, said ink-holding-chamber forming member having a plurality of ink ejecting pores through which ink is ejected from the ink holding chamber by a pressure of the bubble.

14. An apparatus according to claim 13, wherein each of said recording head cartridges includes a plurality of light-absorbing members mounted on said light guide means in the ink holding chamber so as to correspond to the ink ejecting pores, said laser beam emitting means emits said laser beam to eject ink from at least a selected one of the ink ejecting pores, and the laser beam emitted into the ink holding chamber through said light guide means is applied on to at least one of said light absorbing members corresponding to at least said selected one of the ink ejecting pores.

* * * * *